United States Patent [19]

Hume et al.

[11] 4,401,394

[45] Aug. 30, 1983

[54] UNIVERSAL END OF RIBBON SENSING SYSTEM

[75] Inventors: James G. Hume, San Ramon; John Sidvers, Pleasanton; Harold S. Foster, Fremont, all of Calif.

[73] Assignee: Xerox Corporation, Stamford, Conn.

[21] Appl. No.: 310,556

[22] Filed: Oct. 13, 1981

[51] Int. Cl.[3] ..... B41J 32/00; B41J 35/36

[52] U.S. Cl. ..... 400/208; 400/249; 250/570

[58] Field of Search ..... 400/249, 219, 208, 239, 400/711; 250/570, 571, 561; 350/292

[56] References Cited

U.S. PATENT DOCUMENTS 4,195,913 4/1980 Dourte et al. ..... 350/292

4,307,969 12/1981 Daughters ..... 400/243

OTHER PUBLICATIONS

IBM Technical Disclosure Bulletin, vol. 23, No. 9, Feb. 1981, pp. 3955-3956.

*Primary Examiner*—Paul T. Sewell

*Attorney, Agent, or Firm*—Serge Abend

[57] ABSTRACT

An end-of-ribbon sensing system which is equally compatible with various arrangements of light emitters and light detectors as utilized in different models of serial impact printers, the sensing system including a unique compound reflector, having a first reflective portion for use in cooperation with one sensing device and having a second reflective portion for use in cooperation with another sensing device. A clear transparent tape segment located near the end of the ribbon is provided to allow light to pass from a light source on the sensors to the reflective portions and back to a photodetector on the sensors.

7 Claims, 7 Drawing Figures

UNIVERSAL END OF RIBBON SENSING SYSTEM

This invention relates, in general, to an improved universal inked ribbon cartridge for impact printers and, in particular, to an end-of-ribbon sensing system which is equally compatible with various arrangements of light emitters and light detectors as utilized in different models of serial impact printers, the sensing system including a unique compound reflector.

Many models of single element serial impact printers are presently commercially available. As each has a different design, it is to be understood that there is generally minimal parts interchangeability as between the products of various companies. Unfortunately, this is also often the case with printers put into the stream of commerce by the same company. For the most part, this does not present a problem since spare parts are manufactured and stocked for each model of machine. A different situation exists with respect to the consumable supplies, i.e., print elements and ribbon supply cartridges, used by the various printers. It would be highly desirable if the supplies were interchangeable from printer to printer. Presently, this is not the case. For example, considering the case of applicants' assignee, Xerox Corporation which puts into commerce several models of impact printers under its own name, by its Office Products Division, and by its Diablo Systems subsidiary, there is no supplies interchangeability as a result of engineering efforts in design programs having different product goals.

Applicants have seen the need for such universality in its assignee's product line and to that end have invented a unique universal ribbon cartridge which will be readily accepted by every serial impact printer presently marketed by Xerox and Diablo. Namely, those bearing the following trademark designations: Diablo HyType I, Diablo HyType II, Diablo Model 630, Xerox Models 800, 850 and 860. In order to be readily accepted in each of the products listed above, the ribbon cartridge has been designed to meet overall size constraints, to accept each of the various printer positioning arrangements, to accept each of the various printer driving arrangements and to cooperate with the various printer end-of-ribbon sensing systems.

It should be understood, at the outset, that the ribbon cartridge under consideration comprises a container housing a supply of inked ribbon, or tape, which is fed out of the housing to a printing station and is returned to the housing for collection. In high speed terminal printer applications, it is imperative that the terminal be accurately "informed" when the supply of ribbon has been exhausted. If this information were not forthcoming, the printer would continue to accept print signals, but no information would be recorded. Much time would be wasted in an attempt to retrieve the non-recorded information. Even with manually operated printers, where the human overseer may visually observe the printing operation, it is desirable to provide an end-of-ribbon signal to the printer to stop the machine when the ribbon is exhausted. Since the amount of ribbon movement for each printing operation is dependent upon the particular character pitch chosen and the particular type of ribbon being used, there is no easy way for the operator to anticipate the end-of-ribbon situation.

Several factors cause the rate of ribbon utilization to be variable. For example, when high print quality is desired, a single strike ribbon will preferably be used. Such a ribbon is designed so that one impact by the type character fractures the ink layer on the carrier ribbon and removes essentially all the ink from that location, transferring it to the image receiving medium. The ribbon is then advanced sufficiently far to allow the next character to be printed to impact against a fresh portion of the ribbon. If a somewhat lesser degree of print quality is acceptable, a multi-strike ribbon may be utilized. The multi-strike ribbon is designed so that the type characters may overstrike the same general area of the ribbon a number of times while still achieving acceptable print quality. The first time the ribbon is impacted, a predetermined percentage of the ink impregnated into the ribbon is released to the record receiving medium, then the ribbon is forwarded an increment of a character width. The next time the ribbon is impacted by a type character, the impacted character releases another predetermined percentage of ink from the overlapped zone of impact and the first predetermined percentage from the unimpacted zone. Depending upon the type of ink and ribbon used, there will be a number of overlapping zones and the overall usage time will vary. In any event, it is obvious that the single strike ribbon will be depleted faster than the same quantity of multi-strike ribbon.

Thus, a fool-proof sensing device must be incorporated into the printer control system in order to stop the printing operation when the ribbon cartridge is depleted. This is accomplished in assignee's printer products by providing the printer with a sensing device comprising a light source and a light detector which when illuminated will trigger a signal indicating that the ribbon is depleted. A short segment of highly reflective foil ribbon is introduced near the end of the ribbon length and will reflect sufficient light from the light source to the light detector to provide a triggering voltage. In the various printer machines identified above, different sensor configurations were employed, as dictated by other design constraints. No attempt has been made to design a uniform sensing arrangement. Now, with thousands of printers already commercially in use, each using and depleting inked ribbons at a rapid rate, it would be highly desirable to provide a single universal ribbon cartridge design which will work equally well with all of assignee's impact printer models.

The major problem and deterrent to universality derives from the variations in positioning of the sensor arrangements and their focal lengths. For example, in the Diablo products, the sensor is located adjacent the ribbon path but in direct interference with the ribbon path locations designed for the Xerox products. Furthermore, the Xerox products do not pass the ribbon along precisely the same path, hence the sensor system focal lengths are different.

In a presently available cartridge, manufactured by Wordex of San Leandro, California and advertised as being "universal", the ribbon passes adjacent the Diablo sensing location and ribbon routing supports have been incorporated within the ribbon cartridge structure to direct the ribbon, and hence the reflective segment thereof, into approximate perpendicular relationship to the Xerox printer sensors for reflecting light to the detector. This construction has been extensively tested and has been found to be highly unreliable since the reflective segment of the ribbon is too far from the sensor's focal plane to reflect sufficient light to trigger the detector.

Therefore, it has been found necessary to devise a light reflection system capable of returning to variously located detectors a sufficient amount of reflected light from their respective light source to trigger the detector. Also, in order to be universal, the reflection system will, of necessity, include at least one reflective surface located at a position substantially remote from the intended operative distance of the light source/detector combination.

The ribbon cartridge of this invention may be carried out, in one form, by providing a container having a top cover section, a bottom cover section and a peripheral sidewall section connecting said top and bottom cover sections. Housed within the container is a ribbon supply providing a length of ribbon, a ribbon take-up, and ribbon drive for drawing the ribbon from the supply for collection by the take-up. The universal end-of-ribbon indicating device includes an opening in the bottom cover section of a size sufficient to allow a first sensing device to penetrate into the ribbon cartridge, a second opening in the bottom cover section of a size sufficient to allow second or third sensing devices to penetrate into the ribbon cartridge and guide elements for directing the ribbon for movement in a path of travel adjacent the first opening and remote from the second opening. Also included in the universal indicating device is a reflecting tape segment on the ribbon near the end of its length, for use in cooperation with the first sensing device and a clear transparent tape segment on the ribbon located near its end. A compound reflector, having a first reflective portion for use in cooperation with the second sensing device and having a second reflective portion for use in cooperation with the third sensing device, is positioned on the side of the ribbon remote from the second opening such that light rays must pass through the transparent tape segment as they pass from the printer's sensor device light source to its light detector.

This invention may be carried out in accordance with the following detailed description and with reference to the drawings, in which.

Figure 6:
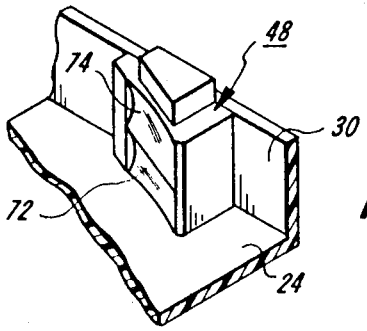
Figure 4:
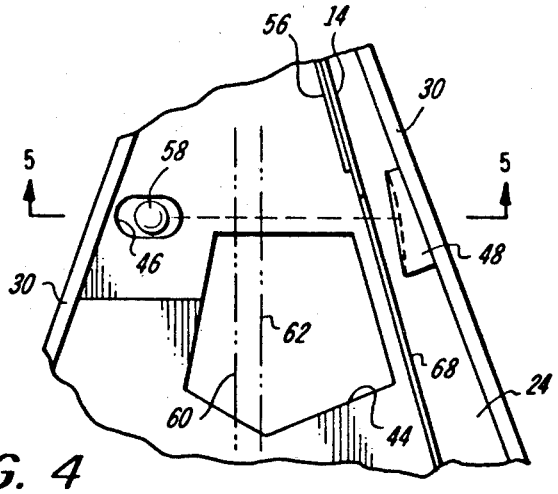
FIG. 4 is an enlarged partial top plan view similar to that of FIG. 2 showing the end-of-ribbon detection system as utilized with another form of light source and detector.
Figure 5A:
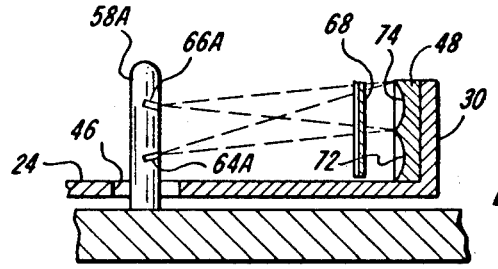
Figure 5B:
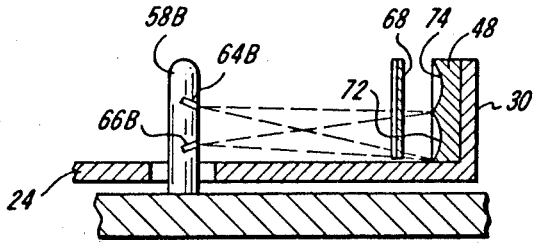

FIG. 5*a* is a side sectional view taken substantially along line 5—5 of FIG. 4 showing one manner in which the light source, detector and compound reflector are utilized;

FIG. 5*b* is a side sectional view taken substantially along line 5—5 of FIG. 4 showing another manner in which the light source, detector and compound reflector are utilized; and FIG. 6 is a perspective view of the compound reflector in place in the ribbon cartridge.

Figure 1:
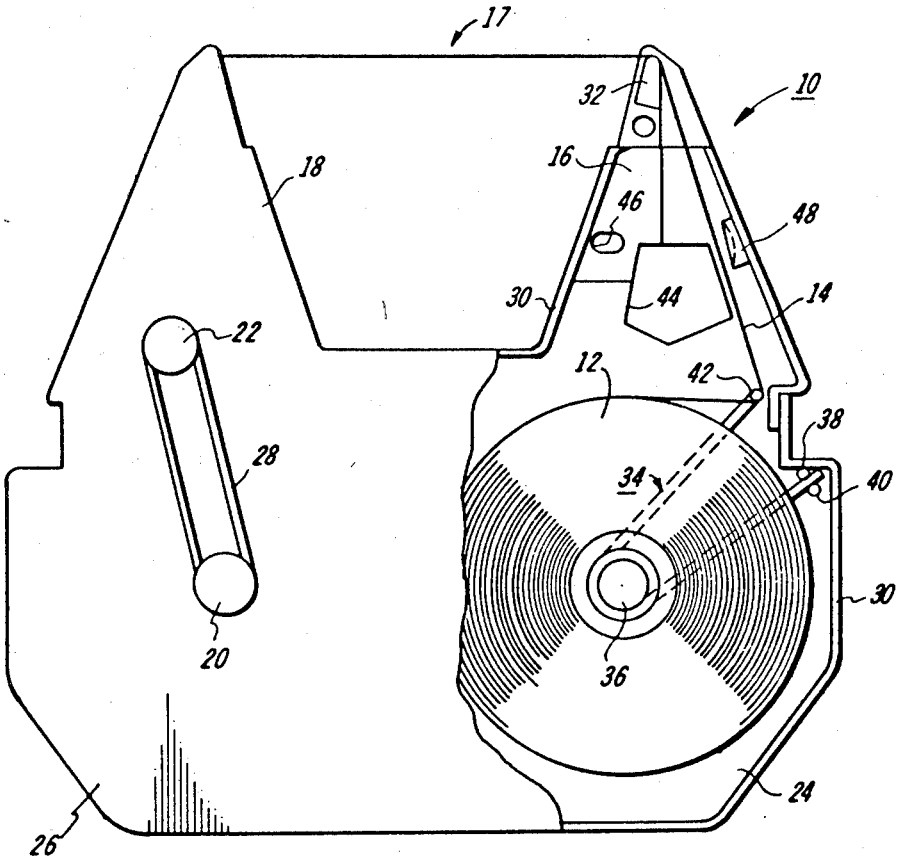
FIG. 1 is a top plan view of the universal ribbon cartridge of this invention, partially broken away to show the universal end-of-ribbon detection system.

With particular reference to the drawings there is illustrated in FIG. 1 a ribbon cartridge 10 made up of upper and lower molded plastic interfitting halves defining an interior volume in which a supply spool 12 of inked ribbon material 14 is housed. The ribbon is unspooled and routed through the interior of the cartridge to an outlet horn 16 from which it exits the cartridge enclosure and traverses a print region 17 prior to reentering inlet horn 18 and being collected on a take-up spool (not shown). The usual take-up spool includes a central shaft 20 which extends outwardly from the top of the cartridge enclosure. A drive roller 22, also extending outwardly from the top of the cartridge enclosure is journalled for rotation in opposing holes in alignment with each other in the bottom wall portion 24 and the top wall portion 26. The drive roller 22 may be driven by the various driving arrangements of the printer models for which this cartridge is compatible, as part of its universality. However, the drive compatibility itself forms no part of the present invention. Ribbon take-up is accomplished by rotating the take-up spool shaft 20 with O-ring 28, which couples the outwardly extending portions of shaft 20 and drive roller 22.

A peripheral sidewall 30 extends between the bottom wall 24 and top wall 26. The wall 30 may be formed integral with either the top wall or the bottom wall, half of the side wall may be formed on each the bottom wall and top wall, or the sidewall may be intermittently integral with the bottom wall and top wall at different portions along the cartridge periphery. Also molded integrally with either the bottom or top walls is an exit guide formation 32 over which the ribbon rides to an opening in the outlet horn 16. A similar guide formation (not shown) is located at the entrance opening of the inlet horn 18.

In order to control the tension in the ribbon 14, a brake 34 is provided around the hub 36 of the spool. The brake 34 is in the form of a spring wire having one end restrained by molded pins 38 and 40, a central portion (not shown) wrapped around the hub 36, and its other end terminating in guide pin 42 over which the ribbon 14 passes. In addition to providing a substantially constant ribbon tension, the guide pin 42 of brake 34, together with exit guide formation 32, establishes a path of travel for the ribbon adjacent an end-of-ribbon detection system.

The invention set forth herein relates to the universal end of ribbon detection system which allows an end-of-ribbon indication to be sensed on all Diablo and Xerox impact printers. In the Diablo impact printers the sensing system comprises a light source and light detector combination positioned on the printers in such a location that it must enter the cartridge enclosure 20 through opening 44. On the other hand, in the Xerox impact printers, the sensing system comprises a light source and light detector combination positioned on the printers in such a location that it must enter the cartridge enclosure 10 through opening 46. These sensing system configurations will cooperate with the compound reflector element 48, as will be described.

Figure 2:
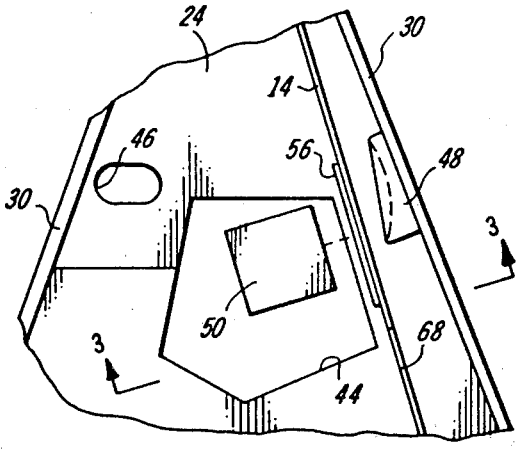
FIG. 2 is an enlarged partial top plan view showing the end-of ribbon detection system as utilized with one form of light source and detector.
Figure 3:
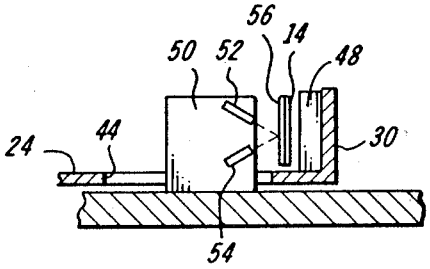
FIG. 3 is a side sectional view taken substantially along line 3—3 of FIG. 2.

In FIGS. 2 and 3 there is shown the universal cartridge of this invention as mounted upon a Diablo impact printer. When in place, the opening 44 in bottom wall 24 receives a sensor housing structure 50 which penetrates into the interior of the ribbon cartridge and cooperates with the ribbon to indicate an end-of-ribbon condition. This is accomplished by means of a suitable light source 52, such as in LED, and photo-detector 54 each aimed at the ribbon 14. As described, the ribbon is directed along a path defined by guide pin 42 and exit guide formation 32 so as to pass adjacent to the sensor 50. The location of the ribbon plane is such that the reflected light from the light source will impinge upon the photodetector as indicated by the dotted lines. Clearly, if the ribbon plane were further from or nearer to the sensor housing structure 50 the reflected light would "miss" the detector. In normal operation, the photodetector will receive insufficient illumination to trigger a sensing circuit because the inked ribbon 14 will not reflect sufficient light. However, at a location near the end of the ribbon, a segment of highly reflective material 56, such as metalized Mylar, is introduced in the ribbon for cooperation with the sensing system. Thus, when the light from the LED 52 hits this highly reflective surface 56, the reflection is received by the photodetector 54 and triggers the printer's controls to terminate operation thereof until the ribbon is replaced.

In the embodiments of FIGS. 4, 5*a* and 5*b*, the universal ribbon cartridge of this invention is shown mounted upon Xerox impact printers. When in place, the opening 46 in the bottom wall 24 receives the sensor post 58*a* or 58*b*. The cartridges previously utilized with these Xerox printers included internal guide elements to pass the ribbon along the paths shown by the single dot phantom line 60 and the double dot phantom line 62. Clearly, this is not possible in the present universal cartridge since such a construction would cause the ribbon path to interfere with the Diablo sensor housing 50. The two phantom lines 60 and 62 represent the paths along which the end-of-ribbon reflective segment 56 must pass in order to cause the light from light sources 64*a*, 64*b* to impinge upon detectors 66*a*, 66*b*, respectively. The location of these paths has been controlled by the positions of light source and light detector on the sensor posts 58*a* and 58*b* and the aimed directions thereof, as present in the various Xerox printers. Furthermore, in the various Xerox printers, the light source and detector combinations can be seen to be reversed. In other words, in FIG. 5*a* the light source 64*a* is below photodetector 66*a* whereas in FIG. 5*b* the light source 64*b* is above photodetector 66*b*.

With the ribbon plane confined to the path of travel shown, and not along phantom lines 60 and 62, it is not possible to utilize the ribbon reflective surface 56 to trigger the photodetectors 66*a* and 66*b*. Therefore, a new sensing system has been devised to allow the photodetectors in various Xerox impact printer products to be triggered by an end-of-ribbon situation. A clear transparent segment 68 is shown to be secured to the end of ribbon 14. It may comprise Mylar or any other suitable strong flexible material and may precede or follow the reflective segment 56.

Positioned directly behind the transparent segment 68, in the direction of the light path shown by the dotted line emanating from the sensor post 58, is a compound reflector element 48 secured to sidewall 30. The element 48 is of generally wedge shape, as viewed in FIG. 4, in order that it may complement the angle of sidewall 30 and present its reflective face in a direction substantially normal to the light path. A metal plated molded plastic reflector has been found to operate quite satisfactorily. In order to reflect light from light sources 64*a* and 64*b* onto their respective photodetectors 66*a* and 66*b*, two collecting surfaces are required. Such an arrangement is necessitated by the fact that the light rays emanating from the light sources diverge in a generally conical manner as illustrated in FIGS. 5*a* and 5*b*. Without a collecting surface the light impinging on a planar reflecting surface would be scattered and would not return to the photodetector with sufficient intensity to trigger the existing sensing circuit.

As illustrated in FIGS. 5*a*, 5*b* and 6, two concave surfaces 70 and 72, one above the other, are provided on element 48. The focal point of each reflective collecting surface corresponds to the location in space of its associated photodetector. Thus, the focal point of curved surface 72 coincides with lower photodetector 66*b* on sensor post 58*b* and the focal point of curved surface 74 coincides with upper photodetector 66*a* on sensor post 58*a*. In this manner, although the light rays from light sources 64*a* and 64*b* spread and are diffused over their longer distance of travel to the reflective surface, they are collected and focussed upon their respective photodetectors to concentrate sufficient illumination to trigger the printer sensing circuit. Curved reflective surfaces in the form of spherical arcs having their radii equal to the distance to the photodetector have been used with good results. Of course, other concave collecting surfaces may also be used satisfactorily.

It should be understood that the present disclosure has been made only by way of example and that numerous changes in details of construction and the combination and arrangement of parts may be resorted to without departing from the true spirit and the scope of the invention as hereinafter claimed.

What is claimed is:

1. A ribbon cartridge having a top cover section, a bottom cover section, a peripheral sidewall section connecting said top and bottom cover sections, a ribbon supply means providing a length of ribbon, ribbon take-up means, and ribbon drive means for drawing ribbon from said supply means for collection by said take-up means, characterized by including universal end of ribbon indicating means comprising:

aperture means in said bottom cover section for allowing penetration into the interior of said ribbon cartridge by a plurality of spaced sensing means;

means for directing said ribbon for movement in a path of travel adjacent said aperture means;

reflecting means located on said ribbon near the end of its length, for use in cooperation with one of said sensing means;

transparent means located on said ribbon near the end of said ribbon length, for use in cooperation with others of said sensing means; and reflector means having a first reflective portion for use in cooperation with a first of said others of said sensing means and having a second reflective portion for use in cooperation with a second of said others of said sensing means, said reflector means being positioned on the side of said ribbon remote from said sensing means.

2. The ribbon cartridge as defined in claim 1 characterized in that said reflector means is positioned in abutting relation to said bottom cover section and said sidewall section.

3. The ribbon cartridge as defined in claim 1 characterized in that said first reflective portion is a curved surface shaped and positioned to collect light emanating from a light source on said first of said others of said sensing means and to focus the light so collected upon a light detector on said first of said others of said sensing means and said second reflective portion is a curved surface shaped and positioned to collect light emanating from a light source on said second of said others of said sensing means and to focus the light so collected upon a light detector on said second of said others of said sensing means.

4. The ribbon cartridge as defined in claim 3 characterized in that said first and second reflective portions are spherical arcs.

5. The ribbon cartridge as defined in claim 4 characterized in that the center of said first spherical arc is located at the spatial location of the operative position of said light detector of said first of said others of said sensing means and the center of said second spherical arc is located at the spatial location of the operative position of said light detector of said second of said others of said sensing means.

6. The ribbon cartridge as defined in claim 1 characterized in that said reflector means is a molded plastic member whose first and second reflective portions are provided with a highly reflective metallized plating.

7. The ribbon cartridge as defined in claim 1 characterized in that said transparent ribbon means is clear.

* * * * *